US006320594B1

(12) United States Patent
Young

(10) Patent No.: US 6,320,594 B1
(45) Date of Patent: Nov. 20, 2001

(54) CIRCUIT AND METHOD FOR COMPRESSING 10-BIT VIDEO STREAMS FOR DISPLAY THROUGH AN 8-BIT VIDEO PORT

(75) Inventor: Bruce A Young, LeMars, IA (US)

(73) Assignee: Gateway, Inc., North Sioux City, SD (US)

( * ) Notice: Subject to any disclaimer, the term of this patent is extended or adjusted under 35 U.S.C. 154(b) by 0 days.

(21) Appl. No.: 09/119,834

(22) Filed: Jul. 21, 1998

(51) Int. Cl.[7] ..... G09G 5/04
(52) U.S. Cl. ..... 345/605
(58) Field of Search ..... 345/153, 154, 345/155, 199, 603, 604, 605; 348/390, 396, 384, 674, 675; 358/16, 32; H04N 5/202, 9/69

(56) References Cited

U.S. PATENT DOCUMENTS

| | | | | |
|---|---|---|---|---|
| 5,012,163 | * | 4/1991 | Alcorn et al. | 315/383 |
| 5,227,863 | * | 7/1993 | Bilbrey | 358/22 |
| 5,519,439 | * | 5/1996 | Keith | 348/396 |
| 6,021,216 | * | 2/2000 | Sathe et al. | 382/166 |

* cited by examiner

*Primary Examiner*—Almis R. Jankus
*Assistant Examiner*—G. F. Cunningham
(74) *Attorney, Agent, or Firm*—Schwegman Lundberg Woessner & Kluth

(57) ABSTRACT

A non-linear digital video compression circuit and method. The video compression circuit includes a source of digital video data signal, wherein the digital video data has M-bits of information for each of a Y, U, and V value per pixel. Y represents a luminance component, and U and V each represent portions of a two-dimensional chromaticity component. The circuit also includes a compression lookup table having an M-bit input coupled to the source of digital video data, and an N-bit compressed digital video data output, where N is less than M. The compression lookup table includes a non-linear compression transformation for at least one of Y, U and V. In one embodiment, the compression lookup table includes a non-linear compression transformation that provides a different conversion for Y than for U or that provides a different conversion for Y than for V. In one such embodiment, the digital video compression circuit further includes a Y-U-V state circuit coupled to the compression lookup table that controls which one of the conversions for Y and U and V is performed. In one such embodiment, M is ten and N is eight (thus providing a 10-bit to 8-bit compression), and the state circuit has an output coupled to the compression lookup table that specifies which one of the conversions is performed.

50 Claims, 7 Drawing Sheets

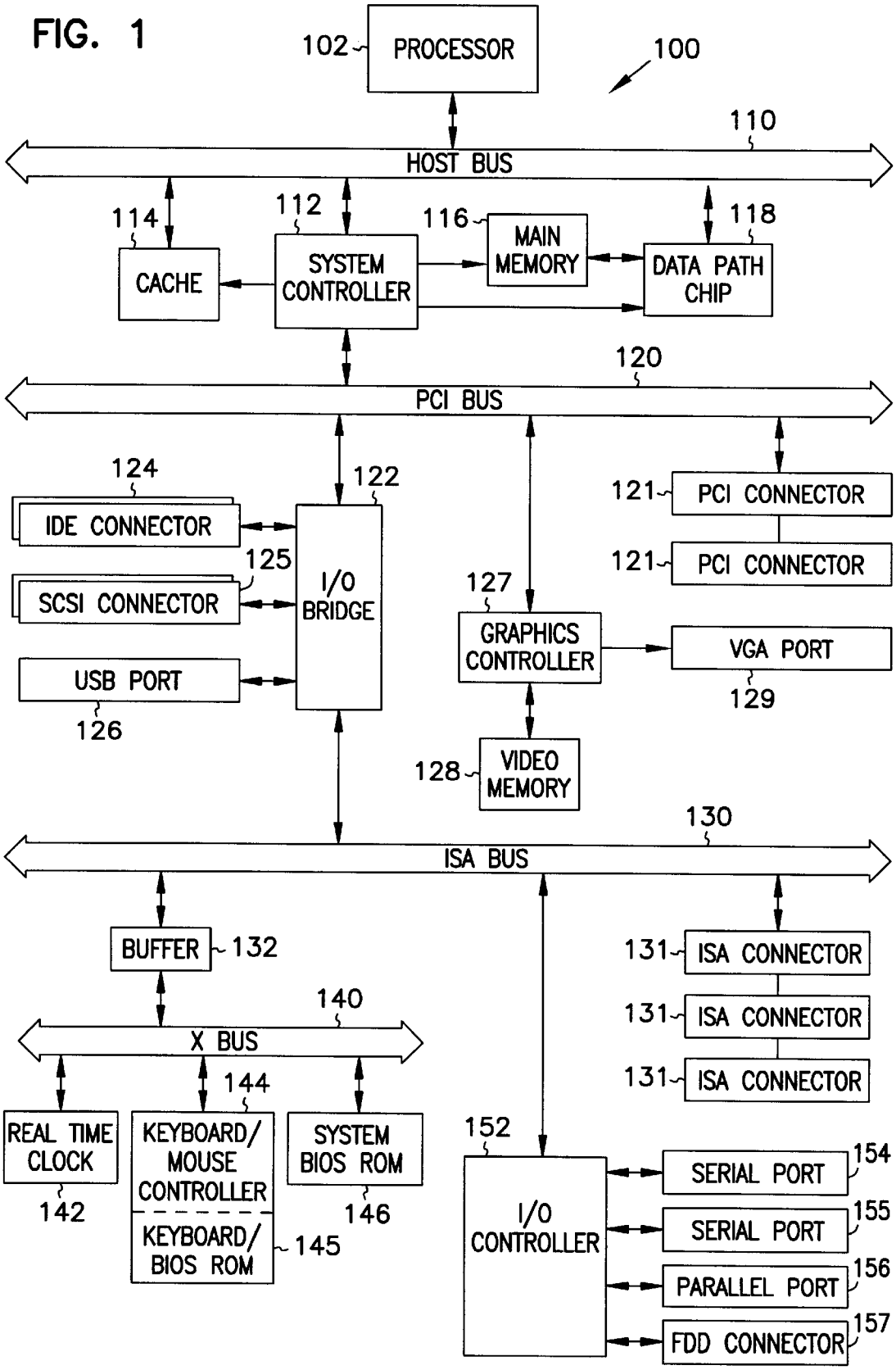
FIG. 1
102
PROCESSOR
100
110
HOST BUS
114
CACHE
112
SYSTEM CONTROLLER
116
MAIN MEMORY
118
DATA PATH CHIP
120
PCI BUS
124
IDE CONNECTOR
125
SCSI CONNECTOR
USB PORT
126
122
I/O BRIDGE
121
PCI CONNECTOR
121
PCI CONNECTOR
127
GRAPHICS CONTROLLER
VGA PORT
129
128
VIDEO MEMORY
130
ISA BUS
BUFFER
132
131
ISA CONNECTOR
131
ISA CONNECTOR
131
ISA CONNECTOR
140
X BUS
REAL TIME CLOCK
142
144
KEYBOARD/ MOUSE CONTROLLER
KEYBOARD/ BIOS ROM
145
SYSTEM BIOS ROM
146
152
I/O CONTROLLER
SERIAL PORT
154
SERIAL PORT
155
PARALLEL PORT
156
FDD CONNECTOR
157

CIRCUIT AND METHOD FOR COMPRESSING 10-BIT VIDEO STREAMS FOR DISPLAY THROUGH AN 8-BIT VIDEO PORT

FIELD OF THE INVENTION

The present invention is related to video compression and in particular to a circuit and method for compressing 10-bit video streams for display through an 8-bit VGA video port of a computer.

BACKGROUND OF THE INVENTION

A standardized YUV video system represents video information using a luminance component (Y) and a two-dimensional chromaticity component (UV). Such representations are sometimes called chromaticity spaces. The YUV system was designed to allow measurement of color differences, and exhibits a correlation between, "distance" computed from coordinate differences and subjective color differences reported by observers.

In some computer systems, digital video signals are provided as streams of ten-bit YUV values: a ten-bit value for Y. the luminance component; a ten-bit value for the U portion of the two-dimensional chromaticity component, and a ten-bit value for the V portion of the two-dimensional chromaticity component.

In many computer video-graphics adaptors, eight-bit values are used for representing colors. Such systems often use three color values for a total of 24 bits representing the color of each pixel.

For speed, cost, and convenience it would be desirable to present digital video in eight-bit quantities, but at the same time preserve subjective qualities of the video signal. Therefore, there is a need for a circuit and method for compressing 10-bit video streams for display through an 8-bit VGA video port of a computer.

SUMMARY OF THE INVENTION

The present invention provides a nonlinear digital video compression circuit and method. The circuit includes a source of digital video data signal, wherein the digital video data has M-bits of information for each of a Y, U, and V value per pixel. Y represents a luminance component, and U and V each represent portions of a two-dimensional chromaticity component. The circuit also includes a compression lookup table having an M-bit input coupled to the source of digital video data, and an N-bit compressed digital video data output, where N is less than M. The compression lookup table includes a non-linear compression transformation for at least one of Y, U and V.

In one embodiment, the compression lookup table of the non-linear digital video compression circuit includes a non-linear compression transformation that provides a different conversion for Y than for U or that provides a different conversion for Y than for V. In one such embodiment, the digital video compression circuit further includes a state circuit coupled to the compression lookup table that controls which one of the conversions for Y and U and V is performed. In one such embodiment, M is ten and N is eight (thus providing a 10-bit to 8-bit compression), and the state circuit has an output coupled to the compression lookup table that specifies which one of the conversions is performed.

In another embodiment, the compression transformation of the non-linear digital video compression circuit further includes a conversion for blanking portions of the digital video data signal. In one such embodiment, the digital video compression circuit further includes a state circuit coupled to the compression lookup table that controls which one of the conversions for Y and U and V and blanking is performed. In one such embodiment, M is ten and N is eight.

Another aspect of the present invention provides a digital video compression circuit and method. This compression circuit includes a source of digital video data signal, the digital video data having M-bits of information for each of a Y, U, and V value per pixel, where Y represents a luminance component, and U and V each represent portions of a two-dimensional chromaticity component. A compression lookup table having an M-bit address input is coupled to the source of digital video data. This compression lookup table has an N-bit compressed digital video data output, where N is less than M. The compression lookup table includes a compression transformation that provides three different conversions for Y and U and V.

In one embodiment, the digital video compression circuit has a compression transformation that further includes a fourth conversion for blanking portions of the digital video data signal. In one such embodiment, the digital video compression circuits further includes a state circuit coupled to the compression lookup table that controls which one of the conversions for Y and U and V and blanking is performed.

In another embodiment, the digital video compression circuit further includes a state circuit coupled to the compression lookup table that controls which one of the three different conversions for Y and U and V is performed. In one such embodiment, M is ten, N is eight, and the state circuit has an output coupled to the compression lookup table that specifies which one of the three conversions is performed.

Yet another aspect of the present invention provides a method for compressing digital video. This method includes the steps of:

providing a digital video data signal, the digital video data having M-bits of information for each of a Y, U, and V value per pixel, where Y represents a luminance component, and U and V each represent portions of a two-dimensional chromaticity component;

performing an M-bit to N-bit compression transformation that is non-linear for at least one of Y, U and V; and outputting N-bit compressed digital video data output having N-bits of information for each of a compressed Y, U, and V value per pixel, where N is less than M.

In one embodiment, the method includes a compression transformation that provides a different conversion for Y than for U or that provides a different conversion for Y than for V.

In another embodiment, the method includes a compression transformation that further includes a conversion for blanking portions of the digital video data signal.

In yet another embodiments, the method further includes the step of determining a state of at least Y, U, or V, wherein the state controls which one of the conversions for Y and U and V and blanking is performed, or the step of determining a state of at least Y, U, or Y. wherein the state controls which one of the conversions for Y and U and V is performed.

In some embodiments of the methods described above, M is ten and N is eight.

BRIEF DESCRIPTION OF THE DRAWINGS

FIG. 1 is a block diagram of a computer system according to the present invention.

DESCRIPTION OF THE EMBODIMENTS

Figure 2A:
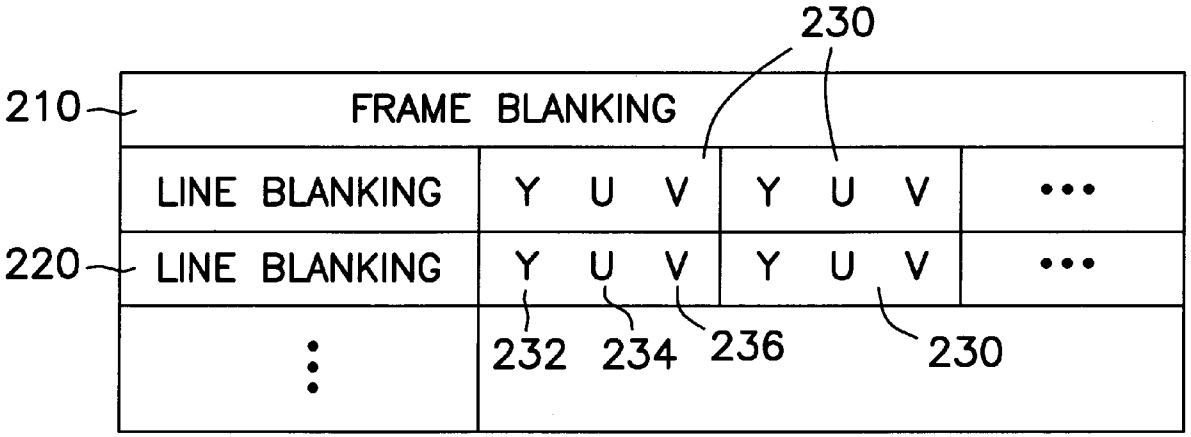
FIG. 2A shows a representation of a YUV data stream 200.

In the following detailed description of the embodiments, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present inventions. The following detailed description is, therefore, not to be taken in a limiting sense, and the scope of the present inventions is defined only by the appended claims.

The leading digits of reference numbers appearing in the Figures generally correspond to the Figure number, with the exception that the same reference number is used throughout to refer to an identical component which appears in multiple Figures. Signals and connections may be referred to by the same reference number or label, and the actual meaning will be clear from its use in the context of the description.

FIG. 1 shows a block diagram of a computer system 100 according to the present invention. In this embodiment, processor 102, system controller 112, cache 114, and data-path chip 118 are each coupled to host bus 11O. Processor 102 is a microprocessor such as a 486-type chip, a Pentium®, Pentium II® or other suitable microprocessor. Cache 114 provides high-speed local-memory data (in one embodiment, for example, 512 KB of data) for processor 102, and is controlled by system controller 112, which loads cache 114 with data that is expected to be used soon after the data is placed in cache 112 (i.e., in the near future). Main memory 116 is coupled between system controller 114 and data-path chip 118, and in one embodiment, provides random-access memory of between 16 MB and 128 MB of data. In one embodiment, main memory 116 is provided on SIMs (Single In-line Memory Modules), while in another embodiment, main memory 116 is provided on DIMMs (Dual In-line Memory Modules), each of which plugs into suitable sockets provided on a motherboard holding many of the other components shown in FIG. 1. Main memory 116 includes standard DRAM (Dynamic Random-Access Memory), EDO (Extended Data Out) DRAM, SDRAM (Synchronous DRAM), or other suitable memory technology. System controller 112 controls PCI (Peripheral Component Interconnect) bus 120, a local bus for system 100 that provides a high-speed data path between processor 102 and various peripheral devices, such as video, disk, network, etc. Data-path chip 118 is also controlled by system controller 112 to assist in routing data between main memory I16, host bus 110, and PCI bus 120.

In one embodiment, PCI bus 120 provides a 32-bit-wide data path that runs at 33 MHZ. In another embodiment, PCI bus 120 provides a 64-bit-wide data path that runs at 33 MHZ. In yet other embodiments, PCI bus 120 provides 32-bit-wide or 64 -bit-wide data paths that runs at higher speeds. In one embodiment, PCI bus 120 provides connectivity to 1/O bridge 122, graphics controller 127, and one or more PCI connectors 121, each of which accepts a standard PCI card. In one embodiment, I/O bridge 122 and graphics controller 127 are each integrated on the motherboard along with system controller 112, in order to avoid a board-connector-board signal-crossing interface and thus provide better speed and reliability. In the embodiment shown, graphics controller 127 is coupled to a video memory 128 (that includes memory such as DRAM, EDO DRAM, SDRAM, or VRAM (Video Random-Access Memory)), and drives VGA (Video Graphics Adaptor) port 129. VGA port 129 can connect to VGA-type or SVCA (Super VGA)-type displays. Other input/output (I/O) cards having a PCI interface can be plugged into PCI connectors 121.

FIG. 1 shows a block diagram of a computer system 100 according to the present invention. In this embodiment, processor 102, system controller 112, cache 114, and data-path chip 118 are each coupled to host bus 110. Processor 102 is a microprocessor such as a 486-type chip, a Pentium®, Pentium II® or other suitable microprocessor. Cache 114 provides high-speed local-memory data (in one embodiment, for example, 512 KB of data) for processor 102, and is controlled by system controller 112, which loads cache 114 with data that is expected to be used soon after the data is placed in cache 112 (i.e., in the near future). Main memory 116 is coupled between system controller 114 and datapath chip 118, and in one embodiment, provides random-access memory of between 16 MB and 128 MB of data. In one embodiment, main memory 116 is provided on SIMMs (Single In-line Memory Modules), while in. another embodiment, main memory 116 is provided on DZMs (Dual In-line Memory Modules), each of which plugs into suitable sockets provided on a motherboard holding many of the other components shown in FIG. 1. Main memory 116 includes standard DRAM (Dynamic Random-Access Memory), EDO (Extended Data Out) DRAM, SDRAM (Synchronous DRAM), or other suitable memory technology. System controller 112 controls PCI (Peripheral Component Interconnect) bus 120, a local bus for system 100 that provides a high-speed data path between processor 102 and various peripheral devices, such as graphics devices, storage drives, network cabling, etc. Data-path chip 118 is also controlled by system controller 112 to assist in routing data between main memory 116, host bus 11O, and PCI bus 120.

In one embodiment, PCI bus 120 provides a 32-bit-wide data path that runs at 33 MHZ. In another embodiment, PCI bus 120 provides a 64-bit-wide data path that runs at 33 MHZ. In yet other embodiments, PCI bus 120 provides 32-bit-wide or 64-bit-wide data paths that runs at higher speeds. In one embodiment, PCI bus 120 provides connectivity to I/O bridge 122, graphics controller 127, and one or more PCI connectors 121 (i.e., sockets into which a card edge may be inserted), each of which accepts a standard PCI card. In one embodiment, I/O bridge 122 and graphics controller 127 are each integrated on the motherboard along with system controller 112, in order to avoid a board-connector-board signal-crossing interface and thus provide better speed and reliability. In the embodiment shown, graphics controller 127 is coupled to a video memory 128 (that includes memory such as DRAM, EDO DRAM, SDRAM, or VRAM (Video Random-Access Memory)), and drives VGA (Video Graphics Adaptor) port 129. VGA port 129 can connect to industry-standard monitors such as VGA-type, SVGA (Super VGA)-type, XGA-type (extended Graphics Adaptor) or SXGA-type (Super XGA) display devices. Other input/output (I/O) cards having a PCI interface can be plugged into PCI connectors 121.

In one embodiment, I/O bridge 122 is a chip that provides connection and control to one or more independent IDE connectors 124, one or more SCSI (small computer systems interface) connectors 125, to a USB (Universal Serial Bus) port 126, and to ISA (Industry Standard Architecture) bus 130. In this embodiment, IDE connector 124 provides connectivity for up to two standard IDE-type devices such as hard disk drives, CDROM (Compact Disk-Read-Only Memory) drives, DVD (Digital Video Disk) drives, or TBU (Tape-Backup Unit) devices. In one similar embodiment, two IDE connectors 124 are provided, and each provide the EIDE (Enhanced IDE) architecture. In the embodiment shown, SCSI (Small Computer System Interface) connector 125 provides connectivity for up to seven or fifteen SCSI-type devices (depending on the version of SCSI supported by the embodiment). In one embodiment, I/O bridge 122 provides ISA bus 130 having one or more ISA connectors 131 (in one embodiment, three connectors are provided). In one, embodiment, ISA bus 130 is coupled to 110 controller 152, which in turn provides connections to two serial ports 154 and 155, parallel port 156, and FDD (Floppy-Disk Drive) connector 157. In one embodiment, ISA bus 130 is connected to buffer 132, which is connected to X bus 140, which provides connections to real-time clock 142, keyboard/mouse controller 144 and keyboard BIOS ROM (Basic Input/Output System Read-Only Memory) 145, and to system BIOS ROM 146.

FIG. 1 shows one exemplary embodiment of the present invention, however other bus structures and memory arrangements are specifically contemplated.

In one embodiment, I/O bridge 122 is a chip that provides connection and control to one or more independent IDE connectors 124–125, to a USB (Universal Serial Bus) port 126, and to ISA (Industry Standard Architecture) bus 130. In this embodiment, IDE connector 124 provides connectivity for up to two standard IDE-type devices such as hard disk drives or CDROM (Compact Disk-Read-Only Memory) drives, and similarly IDE connector 125 provides connectivity for up to two IDE-type-devices. In one such embodiment, IDE connectors 124 and 125 each provide the EIDE (Enhanced IDE) architecture. In one embodiment, I/O bridge 122 provides ISA bus 130 having one or more ISA connectors 131 (in one embodiment, three connectors are provided). In one embodiment, ISA bus 130 is coupled to I/O controller 152, which in turn provides connections to two serial ports 154 and 155, parallel port 156, and FDD (Floppy-Disk Drive) connector 157. In one embodiment, ISA bus 130 is connected to buffer 132, which is connected to X bus 140, which provides connections to real-time clock 142, keyboard/mouse controller 144 and keyboard BIOS ROM (Basic Input/Output System Read-Only Memory) 145, and to system BIOS ROM 146.

Ten-bit resolution is typically required in order for a video stream to be considered "broadcast-quality" video. Current video-graphics adaptor (VGA) controllers in common use support only eight-bit resolution. The present invention provides a non-linear conversion on the video stream, compressing the ten-bit values to eight-bit values while preserving as much as possible of the dynamic range and the color as perceived by a user. Further, a gamma correction is provided in some embodiments. Still further, the display characteristics of a particular VGA display subsystem are compensated for in some embodiments. In contrast, a "compression" scheme that merely truncated or rounded each ten-bit value to an eight-bit value are linear and would lose dynamic range or color fidelity, and give too little freedom in preserving or changing the dynamic range of the video stream. Often, pixel representations whose values differ only in the lower two bits of their ten-bit YUV values should be represented by different colors, something not possible if the lower two bits are merely truncated by the compression scheme.

The present invention, thus, uses a non-linear compression transformation on at least one of Y, U and V, and preferably on all three values of every pixel.

FIG. 2A shows a representation of a YUV data stream 200. One or more frame-blanking values 210 provide a synchronization reference for the start of a video image frame. One or more line-blanking values 220 provide a synchronization reference for the start of a video image line. Following the line blanking, a plurality of pixels 230 are presented, each pixel represented by a Y value 232, a U value 234, and a V value 236.

In one embodiment, the frame blanking and line blanking portions of the signal are separated, and an "active" signal is provided only during the time that A, U, and V values are presented, and thus only the Y, U, and V values are transformed by the lookup table transformation.

Figure 2B:
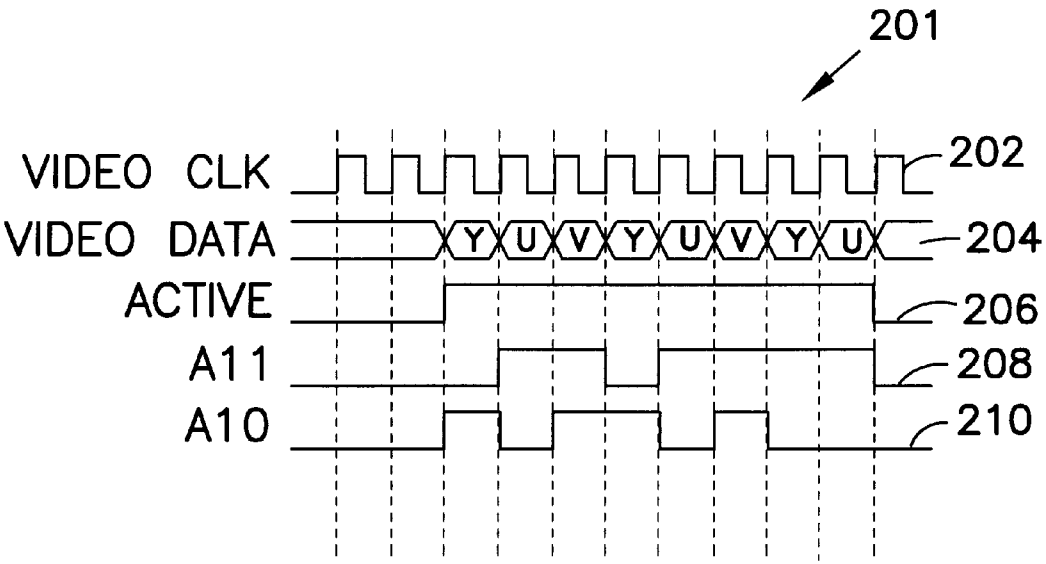
FIG. 2B is a idealized timing diagram of YUV video data and associated clocks and address signals.

FIG. 2B is a timing diagram 201 of YUV video data and associated clocks and address signals. Video clock 202 provides a timing reference for the YUV data. Video data 204 provides y, u, and V data on successive clocks of video clock 202. "Active" signal 206 provides an indication of when the YUV data is active. A11 signal 208 and A10 signal 210 provide state information to the storage used for the table lookup function used for the non-linear compression function.

Figure 3:
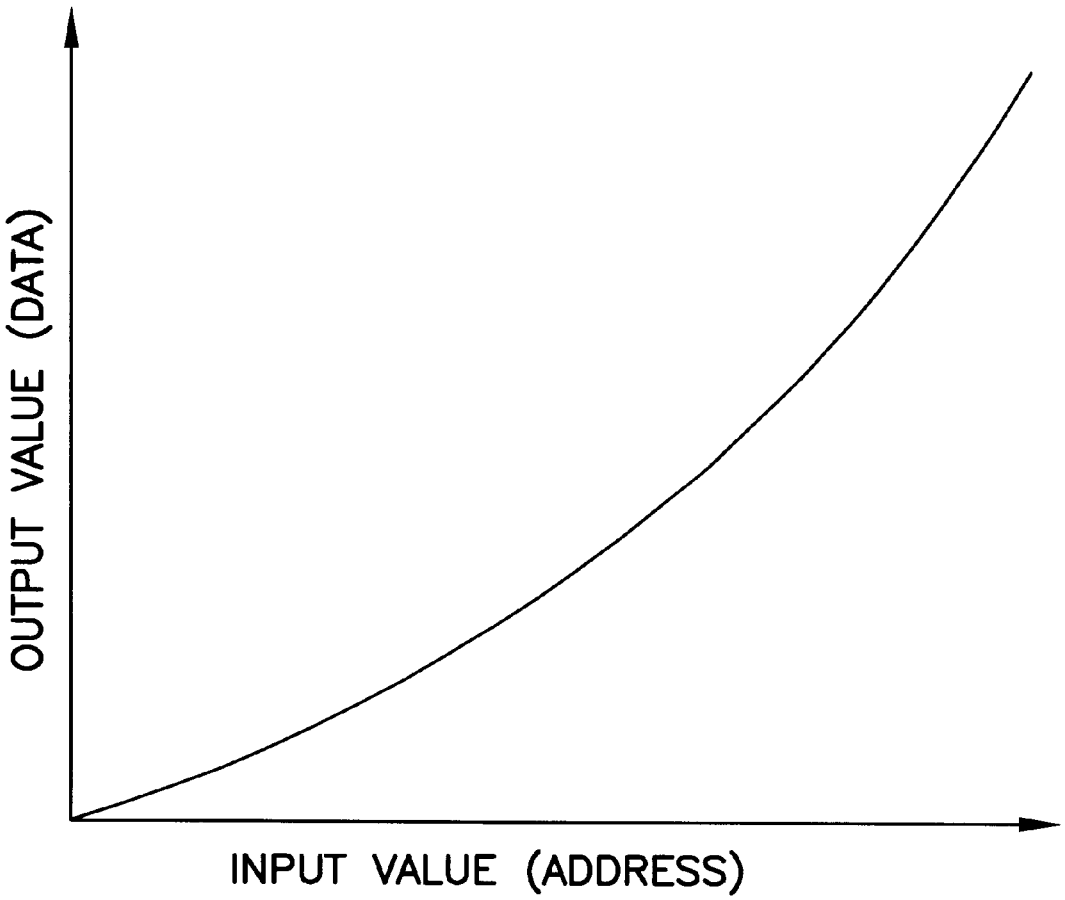
FIG. 3 is an exaggerated graph showing one non-linear transformation from 10-bit input address to 8-bit output value.

FIG. 3 is an exaggerated graph showing one non-linear transformation from 10-bit input address to 8-bit output value for one embodiment of the present invention. The transformation of FIG. 3 can be used to provide gamma correction to the Y component of the signal. In one embodiment, different transformations are provided for Y than for U, and than for V. In one embodiment, the exact transformation to be used is derived empirically by varying the curve of the transfer function and determining which of the various transfer functions provides the most aesthetically pleasing result. Further variations are then performed, and the best result is iteratively obtained. Once obtained, the transformation can be either permanently written into a read-only memory lookup table, or can be placed into a read-write memory for use.

Figure 4A:
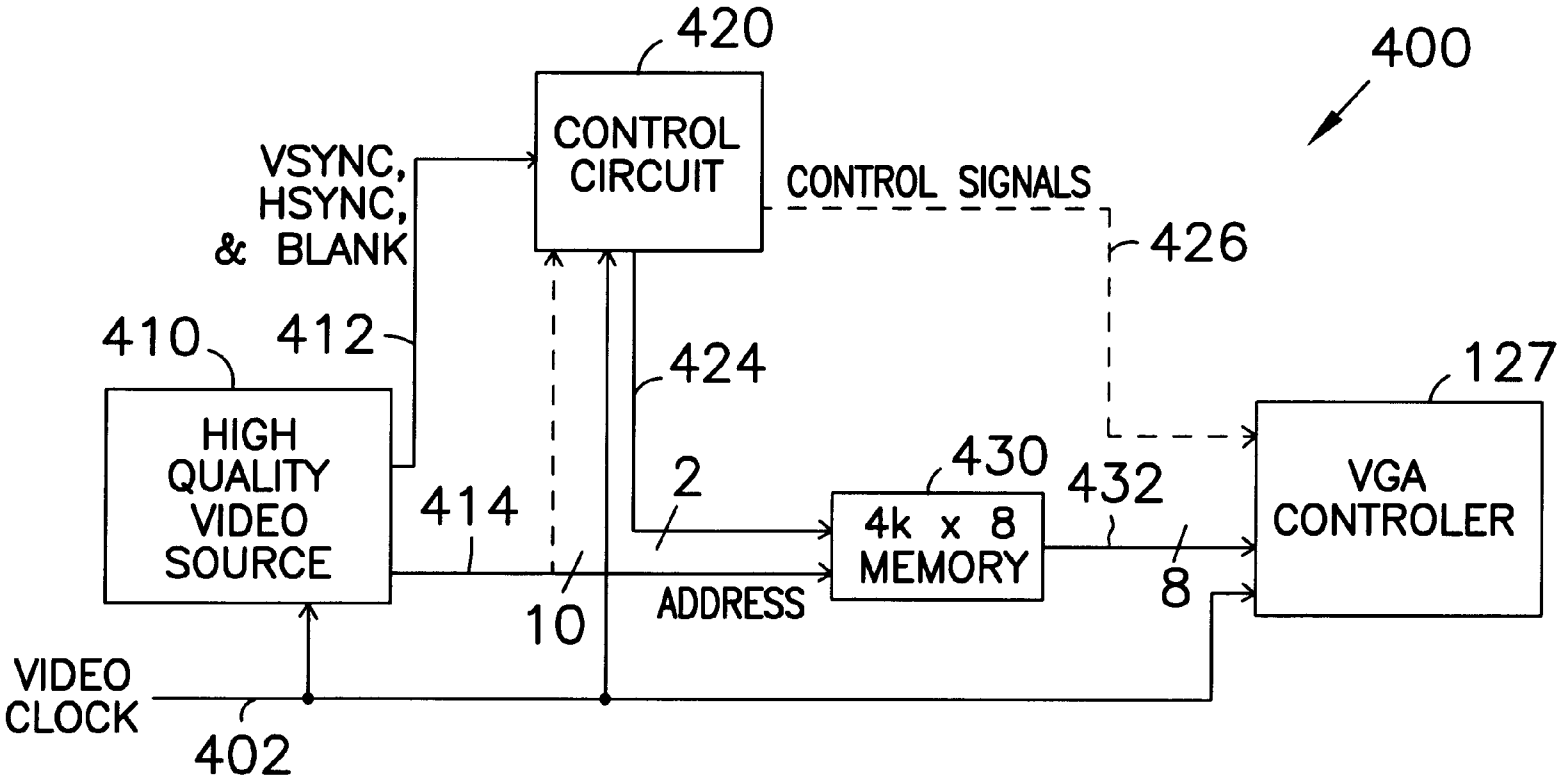
FIG. 4A is a block diagram of one circuit to compress YUV digital video data according to the present invention.

FIG. 4A is a block diagram of a circuit to compress YUV digital video data according to the present invention. In this embodiment , a high-quality video source 410 presents a YUV video data stream 414 having 10-bit values for Y, U, and V presented for each successive image pixel (picture element). The video stream also includes blanking/synchronization signals for each frame and for each line within a frame. In this embodiment, video synchronization (VSYNC), horizontal synchronization (HSYNC), and blanking (BLANK) are separated and provided to control circuit 420. In one embodiment, video data stream 414 is implemented as a 10-bit-wide parallel bus. State machine 420 is controlled by data stream 414, and outputs a 2-bit state, value 424 indicative of one of four states: blanking, Y, U, or V, corresponding to the ten-bit value on data stream 414.

Figure 4B:
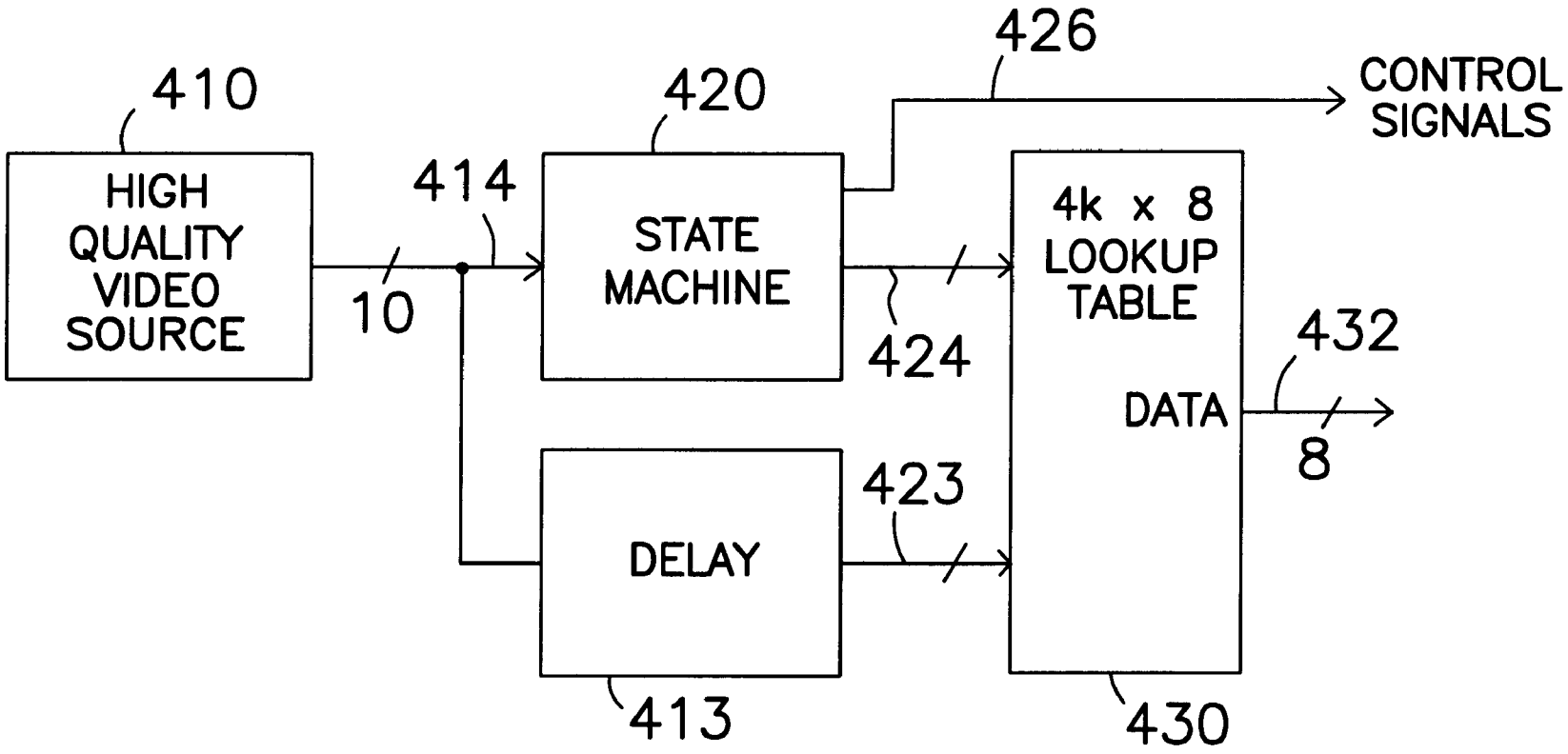
FIG. 4B is a block diagram of another circuit to compress YUV digital video data according to the present invention.

In one embodiment as shown in FIG. 4B, since there is some amount of delay in generating 2-bit state value 424, a delay circuit 413 adjusts the timing of the ten-bit data stream 414, and thus outputs delayed data stream 423 in order to match the timing of 2-bit state value 424. In this embodiment, state machine (control circuit) 420 also derives the VSYNC, HSYNC, and blanking timing signals, as well as the Y, U, and V state from the ten-bit wide signal 414. In this embodiment, two-bit state value 424 and ten-bit delayed data stream 423 together form a twelve-bit address used as an input to lookup table (LUT) 430. LUT 430 then generates 8-bit converted data stream 432.

Control circuit 420 keeps track of whether the current 10-bit value from the video source 410 is a luminance value (Y), or Cr (U) or Cb (V) value, or if the video is in a blanking period. In one embodiment, during the blanking period, straight truncation is used, wherein the upper-order eight bits of the ten-bit input are used for the eight-bit output. In one such embodiment, this preserves CCIR656 standard codes which are embedded in the blanking portion of the video stream.

In some embodiments, such as shown in FIG. 4A, the video source 410 provides certain control signals such as VSYNC and HSYNC which are easily used to determine the start of the YUV sequences and to enable the "active" signal for each line. Many video sources, such as certain video digitizers and MPEG decoders, provide such separate timing and control signals. The embodiment shown in FIG. 4A is also "synchronous" in that video clock 402 is used to synchronize tinning in the circuit. In other embodiments such as shown in FIG. 4B, codes embedded in the video stream need to be interpreted in order to determine the video timing. The embodiment shown in FIG. 4B is "partially asynchronous" in no video clock is used to synchronize timing in the circuit, but rather, fast enough logic (and appropriate delay logic as needed) is used to meet address set-up times. In some synchronous embodiments such as FIG. 4A, corresponding delay logic is used to ensure that control/clock signals arrive in sync with the data/address signals.

Figure 5:
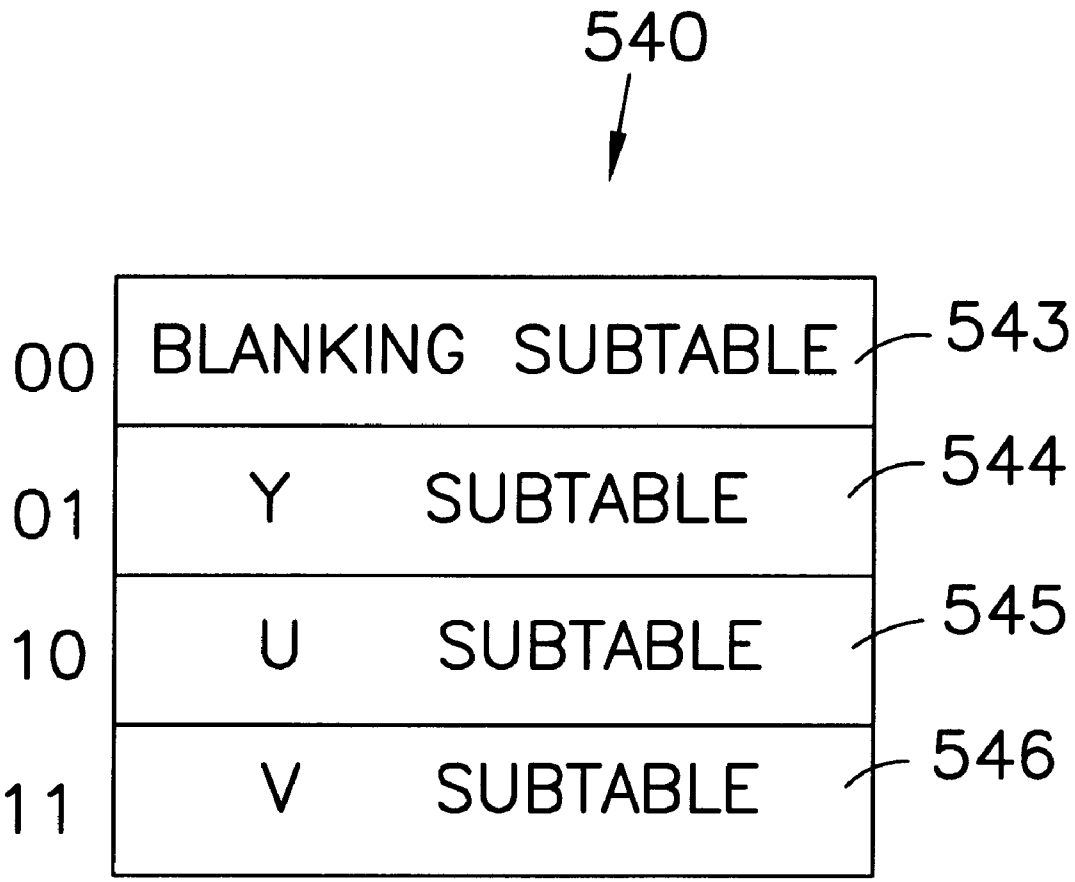
FIG. 5 is a block diagram of lookup table 540.

Effectively, 2-bit state value 424 identifies one of four look-up subtables, the four subtables corresponding to blanking, Y, U, and V. FIG. 5 shows LUT 540 including blanking subtable 543, Y subtable 544, U subtable 545, and V subtable 546. In one embodiment, each subtable includes 1024 eight-bit values, wherein the two-bit state value 424 selects one of the subtables, and the corresponding ten-bit value from delayed data stream 423 selects one of the eight-bit data values to output. Since each subtable is independent of the others, different compression/conversion transformations can be used for each of the four components of data stream 414.

In one embodiment, since its contents need not change, LUT 540 is implemented as a read-only memory (ROM) of any suitable technology (e.g., normal ROM, electrically programmable ROM (EPROM), or electrically erasable and programmable ROM (EEPROM)). In other embodiments, LUT 540 is implemented in. loadable readable and writeable random-access memory (RAM), and in these embodiments, the contents of LUT 540 can be changed from time to time as needed or desired by the user. For example, a software-controlled brightness and contrast control can be implemented by changing the transformation curve for the luminescence by changing the contents of the Y subtable 544. Similarly, the color of the display output. can be changed by software from time to time by changing the transformation curves in the U and/or V subtables 545 and 546. Similarly, the characteristics of particular display subsystems can be compensated for by loading subtables optimized for those display subsystems.

Thus, the blanking subtable 543 can be used to remove noise or other unwanted data or artifacts from the blanking portions of the video data stream 414. Since state machine determines that the values during the blanking period are to be converted according to the blanking subtable, a wider range of values can be accommodated during the blanking period, and still output blanking values into 8-bit converted data stream 432 that are compatible with the 8-bit VGA display subsystem.

The Y subtable performs a non-linear transformation from 10-bit Y values to 8-bit Y values. In one embodiment, the exact transformations to be used (i.e., the contents of the Y subtable 544) is empirically derived.

In one embodiment, the blanking transformation (in one such embodiment, a pass-through transformation) is stored in locations 0–1023 in LUT 530 (implemented in memory 430); the Y compression data is stored in locations 1024–2047 in LUT 530; the U compression data is stored in locations 2048–3071 in LUT 530; and the V compression data is stored in locations 3072–4095 in LUT 530. As described above, in one embodiment, the non-linear transformations embodied in the Y, U, and V compression data are empirically derived. In one such embodiment, the Y compression, data also include a gamma correction factor such as represented in FIG. 3.

Figure 6:
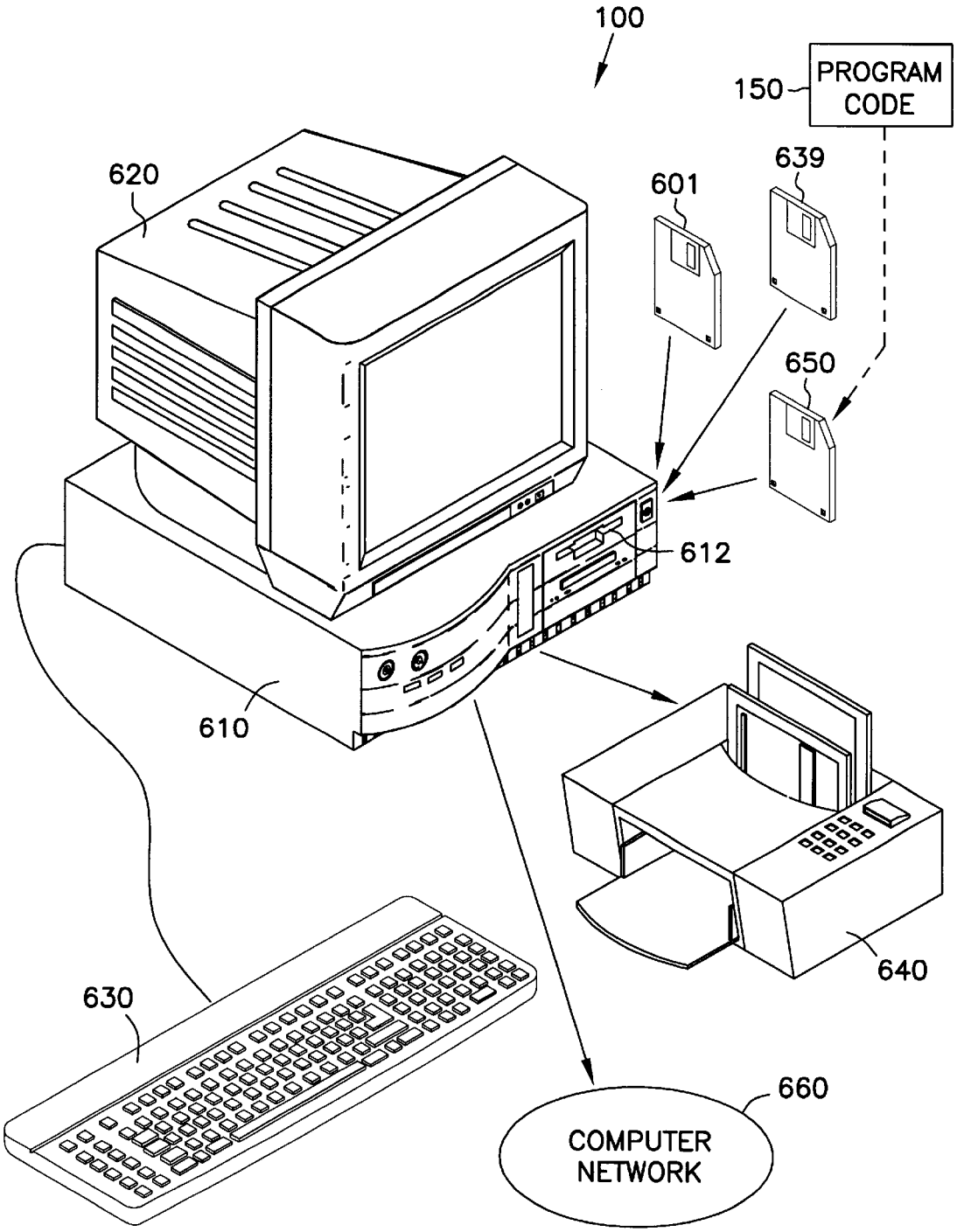
FIG. 6 shows a computer system 100 that employs the video compression of the present invention.

In one embodiment of the present invention as shown in FIG. 6, computer 100 is a complete system that employs the video compression of the present invention. In one such embodiment, system 100 includes removable-media drive 612 (such as a floppy-disk drive, and/or a ZIP-type or a JAZ-type high-capacity drive available from IOMEGA Corporation of Roy, Utah). In one embodiment, removable-media drive 612 is used to read program code 150 from program media 650. Media 650 (such as a floppy disk, a ZIP-type cartridge or a JAZ-type high-capacity cartridge) is suitable for a corresponding removable media drive 612. In that embodiment, program media 650 is used to distribute program code 150 to customers. In another embodiment, computer 100 is connected to computer network 660 (such as a local-area network (LAN), or a wide-area network such as the internet). In such a network environment, program code 150 is read from or written to computer network 660. In one such embodiment, computer network 660 is the media used to distribute program code 150 to customers.

In one embodiment, program code 150 includes code to load the appropriate Y, U, V, and/or blanking transfer function values into LUT 430. In one such embodiment, media 650 also has stored on it data values corresponding to the values to be loaded into LUT 430, such that various transfer functions can be placed onto computer readable media (such as media 650 or network 660) and can be distributed to users in that convenient form. In one such embodiment, more than one variant of the YUV transfer function is included on a single media, so that a user can pick and choose a transfer function best suited for their type of display adaptor, display, or aesthetic sense.

It is to be understood that the above description is intended to be illustrative, and not restrictive. Many other embodiments Will be apparent to those of skill in the art upon reviewing the above description. The scope of the invention should, therefore, be determined with reference to the appended claims, along with the full scope of equivalents to which such claims are entitled.

What is claimed is:

1. A non-linear digital video compression circuit comprising:

a source of digital video data signal, the digital video data having M-bits of information for each of a Y, U, and V value per pixel, where Y represents a luminance component, and U and V each represent portions of a two-dimensional chromaticity component; and a compression lookup table having a M-bit input coupled to the source of digital video data, and an N-bit compressed digital video data output, where N is less than M, wherein the compression lookup table includes a non-linear compression transformation for at least one of the Y, U and V values, wherein the compression transformation further includes a conversion for blanking portions of the digital video data signal.

2. The non-linear digital video compression circuit according to claim 1, further comprising:

a state circuit coupled to the compression lookup table that controls which one of the conversions for Y and U and V and blanking is performed.

3. A non-linear digital video compression circuit comprising:

a source of digital video data signal, the digital video data having M-bits of information for each of a Y, U, and V value per pixel, where Y represents a luminance component, and U and V each represent portions of a two-dimensional chromaticity component;

a compression lookup table having an M-bit input coupled to the source of digital video data and an N-bit compressed digital video data output, where N is less than M, wherein the compression lookup table includes a non-linear compression transformation for at least one of Y, U and V that provides a different conversion for Y than for U or that provides a different conversion for Y than for V; and a state circuit coupled to the compression lookup table that controls which one of the conversions for Y and U and V is performed.

4. The non-linear digital video compression circuit according to claim 3, wherein M is ten, N is eight, and the state circuit has an output coupled to the compression lookup table that specifies which one of the conversions is performed.

5. A digital video compression circuit comprising:

a source of digital video data signal, the digital video data having M-bits of information for each of a Y, U, and V value per pixel, where Y represents a luminance component, and U and V each represent portions of a two-dimensional chromaticity component; and a compression lookup table having an M-bit address input coupled to the source of digital video data, and an N-bit compressed digital video data output, where N is less than M, wherein the compression lookup table includes a compression transformation that provides three different conversions for Y and U and V, and wherein the compression transformation further includes a fourth conversion for blanking portions of the digital video data signal.

6. The digital video compression circuit according to claim 5, further comprising:

a state circuit coupled to the compression lookup table that controls which one of the conversions for Y and U and V and blanking is performed.

7. A digital video compression circuit comprising:

a source of digital video data signal, the digital video data having M-bits of information for each of a Y, U, and V value per pixel, where Y represents a luminance component, and U and V each represent portions of a two-dimensional chromaticity component;

a compression lookup table having an M-bit address input coupled to the source of digital video data, and an N-bit compressed digital video data output, where N is less than M, wherein the compressions lookup table includes a compression transformation that provides three different conversions for Y and U and V; and a state circuit coupled to the compression lookup table that controls which one of the three different conversions for Y and U and V is performed.

8. The digital video compression circuit according to claim 7, wherein M is ten, N is eight, and the state circuit has an output coupled to the compression lookup table that specifies which one of the three conversions is performed.

9. A method for compressing digital video comprising the steps of:

providing a digital video data signal, the digital video data having M-bits of information for each of a Y, U, and V value per pixel, where Y represents a luminance component, and U and V each represent portions of a two-dimensional chromaticity component;

performing an M-bit to N-bit compression transformation that is non-linear for at least one of Y, U and V; and outputting N-bit compressed digital video data output having N-bits of information for each of a compressed Y, U, and V value per pixel, where N is less than M, wherein the compression transformation further includes a conversion for blanking portions of the digital video data signal.

10. The method according to claim 9, further comprising the step of:

determining a state of at least Y, U, or V, wherein the state controls which one of the conversions for Y and U and V and blanking is performed.

11. A method for compressing digital video comprising the steps of:

providing a digital video data signal, the digital video data having M-bits of information for each of a Y, U, and V value per pixel, where Y represents a luminance component, and U and V each represent portions of a two-dimensional chromaticity component;

performing an M-bit to N-bit compression transformation that is non-linear for at least one of Y, U and V; and outputting N-bit compressed digital video data output having N-bits of information for each of a compressed Y, U, and V value per pixel, where N is less than M; and determining a state of at least Y, U, or V, wherein the state controls which one of the conversions for Y and U and V is performed.

12. The method according to claim 10, wherein M is ten and N is eight.

13. A storage medium having a computer program stored thereon for causing a suitably programmed system to compress digital video by performing the following steps when such program is executed on the system:

providing a digital video data signal, the digital video data having M-bits of information for each of a Y, U, and V value per pixel, where Y represents a luminance component, and U and V each represent portions of a two-dimensional chromaticity component;

performing an M-bit to N-bit compression transformation that is non-linear for at least one of Y, U and V; and outputting N-bit compressed digital video data output having N-bits of information for each of a compressed Y, U, and V value per pixel, where N is less than M, wherein the storage medium further has a data structure stored thereon, wherein the data structure includes values for a lookup table that provides a non-linear compression transformation.

14. A storage medium having a computer program stored thereon for causing a suitably programmed system to compress digital video by performing the following steps when such program is executed on the system:

providing a digital video data signal, the digital video data having M-bits of information for each of a Y, U, and V value per pixel, where Y represents a luminance component, and U and V each represent portions of a two-dimensional chromaticity component;

performing an M-bit to N-bit compression transformation that is non-linear for at least one of Y, U and V; and outputting N-bit compressed digital video data output having N-bits of information for each of a compressed Y, U, and V value per pixel, where N is less than M, wherein the computer program comprises programming for further causing the system, when such program is executed on the system, to perform the following additional step:

determining a state of at least Y, U, or V, wherein the state controls which one of the conversions for Y and U and V and blanking is performed.

15. The non-linear digital video compression circuit according to claim 1, wherein M is ten and N is eight.

16. The digital video compression circuit according to claim 7, wherein the compression transformation further includes a fourth conversion for blanking portions of the digital video data signal.

17. The method according to claim 9, wherein M is ten and N is eight.

18. The method according to claim 9, wherein the steps are performed in an order other than that shown.

19. The method according to claim 11, wherein M is ten and N is eight.

20. The method according to claim 11, wherein the steps are performed in an order other than that shown.

21. The storage medium according to claim 14 wherein the steps are performed in an order other than that shown.

22. An information-processing system comprising:

a digital video compression circuit including:

a source of digital video data signal, the digital video data having M-bits of information for a blanking portion of the signal, and M-bits of information for each of a Y, U, and V value per pixel, where Y represents a luminance component, and U and V each represent portions of a two-dimensional chromaticity component; and a compression lookup table having an M-bit input coupled to the source of digital video data, and an N-bit compressed digital video data output, where N is less than M, wherein the compression lookup table provides a non-linear compression of at least one of the Y, U, V and blanking portions of the digital video data signal.

23. The information-processing system of claim 22, further comprising:

a bus;

a main memory;

an input/output subsystem operatively coupled transfer data to and from the bus;

a system processor operatively coupled transfer data to and from the main memory and to and from the bus; and a graphics processor operatively coupled receive data from the bus and from the digital video compression circuit.

24. The information-processing system of claim 22, wherein the compression lookup table includes a compression transformation that provides four different conversions for Y and U and V and blanking portions of the digital video data signal.

25. The information-processing system of claim 24, further comprising:

a bus;

a main memory;

an input/output subsystem operatively coupled transfer data to and from the bus;

a system processor operatively coupled transfer data to and from the main memory and to and from the bus; and a graphics processor operatively coupled receive data from the bus and from the digital video compression circuit.

26. The digital video compression circuit according to claim 24, further comprising:

a state circuit coupled to the compression lookup table that controls which one of the conversions for Y and U and V and blanking is performed.

27. The information-processing system of claim 26, further comprising:

a bus;

a main memory;

an input/output subsystem operatively coupled transfer data to and from the bus;

a system processor operatively coupled transfer data to and from the main memory and to and from the bus; and a graphics processor operatively coupled receive data from the bus and from the digital video compression circuit.

28. An information-processing system comprising:

a digital video compression circuit including:

a source of digital video data signal, the digital video data having M-bits of information for each of a Y, U, and V value per pixel, where Y represents a luminance component, and U and V each represent portions of a two-dimensional chromaticity component;

a compression lookup table having an M-bit address input coupled to the source of digital video data, and an N-bit compressed digital video data output, where N is less than M, wherein the compression lookup table includes a compression transformation that provides three different conversions of Y and U and V; and a state circuit coupled to the compression lookup table that controls which one of the three different conversions for Y and U and V is performed.

29. The information-processing system of claim 28, further comprising:

a bus;

a main memory;

an input/output subsystem operatively coupled transfer data to and from the bus;

a system processor operatively coupled transfer data to and from the main memory and to and from the bus; and a graphics processor operatively coupled receive data from the bus and from the digital video compression circuit.

30. The digital video compression circuit according to claim 28, wherein the compression lookup table includes a non-linear compression transformation for at least one of Y, U and V.

31. The information-processing system of claim 30, further comprising:

a bus;

a main memory;

an input/output subsystem operatively coupled transfer data to and from the bus;

a system processor operatively coupled transfer data to and from the main memory and to and from the bus; and a graphics processor operatively coupled receive data from the bus and from the digital video compression circuit.

32. A method for compressing digital video comprising:

providing a digital video data signal, the digital video data having M-bits of information for a each of a Y portion, a U portion, a V portion, and a blanking portion of the signal, where Y represents a luminance component, and U and V each represent portions of a two-dimensional chromaticity component;

performing an M-bit to N-bit compression transformation that is non-linear for at least one of the Y, U, V, and blanking portions; and outputting N-bit compressed digital video data output having N-bits of information for each of a compressed Y, U, V, and blanking portion, where N is less than M.

33. The method according to claim 32, further comprising:

determining a state of at least Y, U, or V, wherein the state controls which one of the conversions for Y and U and V and blanking is performed.

34. A storage medium having a computer program stored thereon for causing a suitably programmed system to compress digital video by performing the method according to claim 33.

35. A storage medium having a computer program stored thereon for causing a suitably programmed system to compress digital video by performing the method according to claim 32.

36. A method for compressing digital video comprising:

providing a digital video data signal, the digital video data having M-bits of information for each of a Y, U, and V value per pixel, where Y represents a luminance component, and U and V each represent portions of a two-dimensional chromaticity component.

determining a state of at least Y, U, and V;

performing an M-bit to N-bit compression transformation that is non-linear for at least one of Y, U and V, wherein the state controls which one of the conversions for Y and U and V is performed; and outputting N-bit compressed digital video data output having N-bits of information for each of a compressed Y, U, and V value per pixel, where N is less than M.

37. A storage medium having a computer program stored thereon for causing a suitably programmed system to compress digital video by performing the method according to claim 36.

38. A storage medium comprising:

a computer program stored on the storage medium for causing a suitably programmed system to compress digital video by performing the following method when such program is executed on the system:

providing a digital video data signal, the digital video data having M-bits of information for each of a Y, U, and V value per pixel, where Y represents a luminance component, and U and V each represent portions of a two-dimensional chromaticity component;

performing a M-bit to N-bit compression transformation that is non-linear for at least one of Y, U and V; and outputting N-bit compressed digital video data output having N-bits of information for each of a compressed Y, U, and V value per pixel, where N is less than M; and a data structure stored thereon, wherein the data structure includes values for a lookup table that provides a non-linear compression transformation, and wherein the digital video data also includes M-bits of information for a blanking portion of the signal, wherein the method further comprises determining a state of at least Y, U, V or blanking, and wherein the compression transformation is performed based on the state.

39. The non-linear digital video compression circuit according to claim 1, wherein the compression lookup table includes a non-linear compression transformation that provides a different conversion for Y than for U.

40. The non-linear digital video compression circuit according to claim 1, wherein the compression lookup table includes a non-linear compression transformation that provides a different conversion for Y than for V.

41. The non-linear digital video compression circuit according to claim 2, wherein the compression lookup table includes a non-linear compression transformation that provides a different conversion for Y than for U.

42. The non-linear digital video compression circuit according to claim 2, wherein the compression lookup table includes a non-linear compression transformation that provides a different conversion for Y than for V.

43. The non-linear digital video compression circuit according to claim 3, wherein the compression lookup table includes a non-linear compression transformation that provides a different conversion for Y than for U.

44. The non-linear digital video compression circuit according to claim 3, wherein the compression lookup table includes a non-linear compression transformation that provides a different conversion for Y than for V.

45. The method according to claim 11, wherein the compression lookup table includes a non-linear compression transformation that provides a different conversion for Y than for U.

46. The method according to claim 11, wherein the compression lookup table includes a non-linear compression transformation that provides a different conversion for Y than for V.

47. The method according to claim 23, wherein the compression lookup table includes a non-linear compression transformation that provides a different conversion for Y than for U.

48. The method according to claim 23, wherein the compression lookup table includes a non-linear compression transformation that provides a different conversion for Y than for V.

49. The information-processing system of claim 22, further comprising:

a state circuit coupled to the compression lookup table that controls which one of the conversions for Y and U and V and blanking is performed;

a bus;

a main memory;

an input/output subsystem operatively coupled transfer data to and from the bus;

a system processor operatively coupled transfer data to and from the main memory and to and from the bus; and a graphics processor operatively coupled receive data from the bus and from the digital video compression circuit.

50. The method according to claim 49, wherein the compression lookup table includes a non-linear compression transformation that provides a different conversion for Y than for U.

* * * * *